US010688002B2

(12) United States Patent
Guo

(10) Patent No.: US 10,688,002 B2
(45) Date of Patent: Jun. 23, 2020

(54) COMBINED MOBILE CART FOR SICK AND WOUNDED

(71) Applicant: Zhejiang Ouhong Technology Co., Ltd., Wenzhou (CN)

(72) Inventor: Zigang Guo, Ningde (CN)

( * ) Notice: Subject to any disclaimer, the term of this patent is extended or adjusted under 35 U.S.C. 154(b) by 147 days.

(21) Appl. No.: 16/015,194

(22) Filed: Jun. 22, 2018

(65) Prior Publication Data

US 2018/0296416 A1 Oct. 18, 2018

Related U.S. Application Data

(63) Continuation of application No. PCT/CN2016/109537, filed on Dec. 12, 2016.

(30) Foreign Application Priority Data

Dec. 25, 2015 (CN) ..... 2015 1 0984331

(51) Int. Cl.
*A61G 7/08* (2006.01)
*A61G 7/10* (2006.01)
(Continued)

(52) U.S. Cl.
CPC ..... *A61G 7/1034* (2013.01); *A61G 1/003* (2013.01); *A61G 7/1011* (2013.01);
(Continued)

(58) Field of Classification Search
CPC ..... A61G 7/08
(Continued)

(56) References Cited

U.S. PATENT DOCUMENTS 4,584,989 A * 4/1986 Stith ..... A61G 7/00 128/870
5,337,845 A * 8/1994 Foster ..... A61G 7/00 180/11

(Continued)

FOREIGN PATENT DOCUMENTS

CN 2572946 Y 9/2003
CN 2730354 Y 10/2005

(Continued)

OTHER PUBLICATIONS

Internation Search Report of PCT/CN2016/109537, dated Feb. 27, 2017.

*Primary Examiner* — Fredrick C Conley
(74) *Attorney, Agent, or Firm* — ZANIP

(57) ABSTRACT

A combined mobile cart for the sick or wounded, includes a mobile cart and a mobile stretcher. The mobile cart includes a main body frame, a left retractable track mechanism, a right retractable track mechanism, a lifting and translating mechanism, and an automatic movable weight-balancing mechanism. The top of the main body frame is provided with the left and right retractable track mechanisms, a supporting layer is arranged in a middle of the main body frame of the mobile stretcher, and the automatic movable weight-balancing mechanism is arranged at a bottom of the main body frame; and the lifting and translating mechanism is provided with a left case body and a right case body, lifting ropes are arranged under the lifting and translating mechanism, and suspension tools are connected with the lifting ropes, so that functions of vertically lifting and vertically moving the mobile stretcher are realized.

6 Claims, 10 Drawing Sheets

(51) Int. Cl.
*A61G 1/003* (2006.01)
*A61G 1/02* (2006.01)

(52) U.S. Cl.
CPC ..... *A61G 7/1015* (2013.01); *A61G 7/1017* (2013.01); *A61G 7/1046* (2013.01); *A61G 7/1055* (2013.01); *A61G 1/02* (2013.01)

(58) Field of Classification Search
USPC ..... 5/600, 81.1, 83.1
See application file for complete search history.

(56) References Cited

U.S. PATENT DOCUMENTS

| | | | | |
|---|---|---|---|---|
| 6,728,979 | B1 * | 5/2004 | Robert | A61G 7/103 5/81.1 HS |
| 8,011,039 | B2 * | 9/2011 | Stryker | A61G 7/001 5/600 |
| 2002/0152555 | A1 * | 10/2002 | Gallant | A61G 7/05 5/658 |
| 2012/0216345 | A1 | 8/2012 | Hand | |

FOREIGN PATENT DOCUMENTS

| | | | |
|---|---|---|---|
| CN | 104970937 | A | 10/2015 |
| CN | 105581874 | A | 5/2016 |
| CN | 205251865 | U | 5/2016 |

* cited by examiner

COMBINED MOBILE CART FOR SICK AND WOUNDED

CROSS-REFERENCE TO RELATED APPLICATIONS

This application is a continuation of International Patent Application No. PCT/CN2016/109537 with a filing date of Dec. 12, 2016, designating the United States, now pending, and further claims priority to Chinese Application No. 201510984331.8 with a filing date of Dec. 25, 2015. The content of the aforementioned applications, including any intervening amendments thereto, are incorporated herein by reference.

TECHNICAL FIELD

The present invention relates to a combined mobile cart for a sick or wounded.

BACKGROUND OF THE PRESENT INVENTION

At present, for a case where the sick or wounded is moved, in particular, the sick or wounded is moved from a place of occurrence to an ambulance and then from the ambulance to the hospital, and in the hospital, still need to be subjected to various examinations, that is, firstly, be subjected to routine examinations, and then be selectively subjected to multiple examinations such as CD, X-ray, nuclear magnetic resonance, and electrocardiogram according to their conditions, and therefore, the sick or wounded must be moved several times, there is no ideal, convenient and feasible mobile tool, which does not cause the secondary injury to the sick or wounded, in China and abroad. A method for moving the sick or wounded manually in combination with a mobile tool is mainly adopted for moving the sick or wounded to a desired position. Such multiple movements have a great impact on the sick or wounded, especially, a special sick or wounded, and a movement process needs many people to cooperate. At present, there are also invention technology reports of a variety of mobile stretchers for the sick or wounded, but all have defects in varying degrees, and accordingly, they have not been applied in the actual clinical applications.

SUMMARY OF PRESENT INVENTION

In view of deficiencies of the prior art, an objective of the present invention is to provide a combined mobile cart for a sick or wounded, which is simple and convenient, small in size, and does not injure the sick or wounded.

A technical solution of the present invention is as follows: a combined mobile cart for a sick or wounded includes a mobile cart and a mobile stretcher, wherein the mobile cart includes a main body frame 14, a left retractable track mechanism 6, a right retractable track mechanism 7, a lifting and translating mechanism 1, and an automatic movable weight-balancing mechanism 18, wherein the top of the main body frame 14 is provided with the left retractable track mechanism 6 and the right retractable track mechanism 7, and a supporting layer 15 is arranged in a middle of the main body frame, the automatic movable weight-balancing mechanism 18 is arranged at a bottom of the main body frame 14, and universal casters 16, a self-contained power supply and a PLC system 30 are arranged under the bottom of the main body frame 14. The retractable track mechanisms include the left retractable track mechanism and the right retractable track mechanism, which are respectively arranged at the left side and the right side on the top of the main body frame 14, and the lifting and translating mechanism is formed respectively by fixedly assembling a left case body 2 and a right case body 3 via a linkage rod 8 and a linkage rod 9 as well as an interval-controlling rod 58 and an interval-controlling rod 59, and supported by left and right case-frame travelling wheels 35 to run on tracks of fixed tracks 10, 11 and retractable tracks 4, 5 on the top of the main body frame 14, so as to reciprocate along an axial line when the retractable tracks deploy. Lifting ropes 43 are arranged below the left case body 2 and the right case body 3 of the lifting and translating mechanism, and suspension tools 12 are connected with the lifting ropes 43 for vertically lifting and vertically moving the mobile stretcher. The automatic movable weight-balancing mechanism 18 is arranged at the bottom of the main body frame 14, may be moved outwards by a drive weight-balancing block 21 to balance a force moment in lifting when the lifting and translating mechanism 1 is moved outwards to a lifting position, and moved towards the inside of the main body frame by the drive weight-balancing block 21 when the lifting and translating mechanism 1 completes vertical lifting and inward movement, so as to reduce the space to facilitate the movement of the mobile cart. The self-contained power supply for supplying power to drive the mobile cart and the PLC system 30 for operation control are arranged at the bottom of the main body frame 14. The mobile stretcher 13 adopts a shovel type mobile stretcher for a sick or wounded (as shown in FIG. 7) or a simple mobile stretcher for a sick or wounded (as shown in FIG. 8) and an easy-to-move mobile stretcher. The mobile stretcher is arranged below the left case body 2 and the right case body 3 of the lifting and translating mechanism of the mobile cart, and the lifting operation for the mobile stretcher 13 is completed by the lifting suspension tools 12 arranged below the left case body 2 and the right case body 3 of the lifting and translating mechanism 1.

Further, the lifting and translating mechanism 1 is formed by assembling the left case body 2 and the right case body 3 via linkage rods 8 and 9 and interval-controlling rods 58 and 59, the case-frame travelling wheels 35 are arranged above the left case body 2 and the right case body 3, a left case lifting passive rope sheave 28 is arranged at the left side on the middle of the left case body 2, a right case lifting active rope sheave 42 is arranged at the left side on the middle of the right case body 3, lifting ropes 43 are encircled on the peripheries of the drive rope sheave and the driven rope sheave, and the lifting ropes are connected with the suspension tools 12 via rope guiding wheels 45 arranged at two sides at the bottom of each of the left case body and the right case body. A drive motor 36 is arranged in the middle inside the right case body, the drive motor 36 is coaxially connected with a right case rope sheave drive active gear 39, the right case rope sheave drive active gear 39 is meshed with a rope sheave drive passive gear 40, the rope sheave drive passive gear 40 and the lifting active rope sheave 42 are coaxially linked with the left case lifting driven rope sheave 28 though the linkage rod 9, such that the lifting ropes 43 drive the suspension tools 12 to vertically move up and down. A left case translating active gear 27 and a right case translating active gear 41 for driving the lifting and translating mechanism 1 to translate on tracks of the retractable track mechanisms are respectively arranged above the middles of the left case body 2 and the right case body 3, a translating drive motor 52 and a left case translating transmission active gear 25 are arranged at an inner side and in the middle of the middle of the left case and are coaxially linked for transmission, the left case translating transmission active gear 25 is meshed with a left case duplicate gear 26, a duplicate gear is combined by the left case translating active gear 27 and the left case duplicate gear 26, the left case duplicate gear is coaxially linked via the linkage rod 8, linked with the right case translating active gear 41 arranged at the upper-right side of the right case, and respectively meshed with racks 62 arranged at lower levels of the retractable tracks above the left case and the right case. When the translating drive motor 52 operates, the left case translating transmission active gear 25 is meshed with the left case duplicate gear 26 to drive the left case translating active gear 27 and the right case translating active gear 41 to be meshed with the racks 62 for operation under the action of the linkage rod 8, so that the lifting and translating mechanism axially translates on the retractable tracks.

Further, the retractable track mechanisms are formed by assembling fixed tracks 10, 11 and retractable tracks 4, 5; deployment drive motors 64 are configured to drive four-bar linkage mechanisms 17, and hence drive the retractable tracks 4, 5; the fixed tracks 10, 11 are symmetrically arranged at the left side and the right side on the top of the main body frame, and racks 61, 62 are arranged at the bottoms of the fixed tracks and the retractable tracks, respectively, and meshed with the left case translating active gear 27 and the right case translating active gear 41 of the lifting and translating mechanism, respectively. The retractable tracks are arranged oppositely in two groups, i.e., the left group and the right group. FIG. 5 is a schematic diagram showing a left group of fixed tracks, retractable tracks and deployment drive mechanisms. The left group and the right group are oppositely arranged, with a common point that the driver mechanisms are arranged at the inner side on the top of the mobile cart and the fixed tracks and the retractable tracks are arranged at the outer side, the retractable tracks 4, 5, are retractably connected with the left fixed tracks 10 and the right fixed tracks 11 by hinges 63, during un-deploying, the retractable tracks 4, 5 are tightly clung to a lateral rod 134 of the main body frame, and during deploying, the retractable tracks 4, 5 are in a cantilever state, at this moment, the lifting and translating mechanism is outwards moved to be in a vertically-lifting operation state. As shown in FIG. 9, racks 61, 62 are arranged at bottoms of two groups of fixed tracks 10, 11 and retractable tracks 4, 5; when the retractable tracks 4, 5 are un-deployed, the lifting and translating mechanism 1 is moved outwards, and the left case translating active gear 27 and the right case translating active gear 41 are respectively meshed with the racks 61, 62. A left group and a right group of four-bar linkage mechanisms 17 driven by the motors are included, and are composed by the deployment drive motors 64, coaxial gears 96 of the deployment drive motors 64, transmission large gears 95, transmission cranks 101, transmission links 104 and retractable tracks 5, and the two groups are correspondingly arranged, the coaxial gears 96 connected with drive motors are meshed with the transmission large gears 95, center holes of the transmission large gears 95 are in key joint with a supporting layer 15 of the mobile cart, and transmission shafts 100 and the transmission cranks 101 are integrally connected, the transmission cranks 101 and the transmission links 104 are slidably connected via hinge pins 103, and the transmission links 104 and the retractable tracks 4, 5 are slidably connected by hinge pins 105, and the deployment drive motors 64 operate forward and backward through a meshing operation of the coaxial gears 96 with the transmission large gears 95 so as to drive the transmission cranks 101 to operate, so that the transmission links 104 and the retractable tracks 4, 5 un-deploy or deploy.

Further, the automatic movable weight-balancing mechanism 18 is arranged at the bottom of the main body frame 14, and is formed by assembling a driving weight-balancing block 21, racks 122, a track 123 and a driving member. The driving weight-balancing block 21 is fixedly disposed within the main body frame 14, and fixed with the racks 122 arranged at the inner side of the driving weight-balancing block. The track 123 is fixed below the driving weight-balancing block 21 and the racks 122, the driving weight-balancing block 21 is connected with a track guide block 126, and the track guide block 126 and the track 123 slide for operation. The driving member is coaxially linked by the driving motor 130 to drive the active gear 128 to operate. The driving motor 130 is fixed on a supporting plate 129 at the bottom of the main body frame to drive the active gear 128 to be meshed with rack driving gears 131 and 133. Two rack driving gears are included, namely, a left rack driving gear 131 and a right rack driving gear 133, which are linked by a linkage rod 132, and the linkage rod 132 is fixed on the driving weight-balancing block by bearing seats 124 and 125. The driving motor 130 operates to drive the active gear 128 to rotate, so as to drive the rack driving gear 131 to rotate, and drive the rack driving gear 133 to rotate under the action of the linkage rod 132, thereby driving the racks 122 connected with the weight-balancing block 21 to operate, and then driving the weight-balancing block 21 to inwards translate along the axial line of the track 123 at the bottom of the main body frame 14.

Further, the mobile stretcher is of a shovel type mobile stretcher for a sick or wounded or a simple mobile stretcher for a sick or wounded, the shovel type mobile stretcher is a rectangular cabinet rack composed by cross rods 20 and longitudinal rods 19 of the stretcher. A plurality of groups of corresponding movable pallet supporting bases 22 are arranged on the cross rods 20 of the stretcher, and through holes are disposed above the movable pallet supporting bases and pass through the cross rods 20 of the stretcher. A constraint key 29 is disposed below the cross rods to constrain that the movable pallet supporting bases make a circumference rotation about axial lines of the cross rods; a key slot is disposed inside the through holes above movable pallets so as to be matched with the constraint key 29; the movable pallets are disposed in rectangular holes below movable pallet bases; and a plurality of lifting hooks 24 are arranged at the longitudinal rods 19. The simple mobile stretcher for the sick or wounded is a rectangular cabinet rack composed of longitudinal rods 70 and cross rods 71, a plurality of movable flexible belts 72 are movably connected with an introduction plate 75 at the bottom of a sick or wounded's body by couplings 76, separated from an introduction sheet after passing through the bottom of the sick or wounded's body under the guidance of the introduction sheet, remained at the bottom of the sick or wounded's body, rapidly fastened by rapid couplings 73 via the cross rods, so as to support the sick or wounded. A plurality of lifting hooks 74 are arranged at the longitudinal rods 70 for matching with the suspension tools 12, which are arranged at the lifting and translating mechanism 1, of the mobile cart to lift and translate the sick or wounded.

Further, a self-contained power supply and a PLC system 30 are arranged below the main body frame.

The present invention has the advantages that a mobile stretcher and a mobile cart are enabled to operate separately, the mobile stretcher (including a shovel type mobile stretcher for a sick or wounded or a simple mobile stretcher for a sick or wounded and an easy-to-move mobile stretcher) is firstly adopted to place the sick or wounded on the mobile stretcher; and then the mobile cart is used to perform cantilever lifting on the sick or wounded, then translate the sick or wounded to the center of the mobile cart, and finally stably place the sick or wounded on a supporting layer. Such a process is light, uniform, and stable, and has no psychological harm or other harms to the sick or wounded. The mobile cart adopts a foldable depolyable track apparatus and a retractable weight-balancing mechanism apparatus, which not only ensures the stability during the cantilever lifting, but also may reduce the size of the mobile cart, so that the mobile cart may conveniently transfer the sick or wounded in a ward, especially conveniently access the ward and easily move within the small space inside the ward. A separate operation of the mobile stretcher and the mobile cart may flexibly cope with various conditions. For special road conditions, a method of manually lifting and moving the stretcher may be directly used for movement. In such a method, parts where the lifting hooks and the mobile stretcher are connected may be directly separated on the mobile cart, and then the mobile stretcher may be manually lifted for manual movement. For examinations with special requirements, for example, the nuclear magnetic resonance does not allow any metal material to enter an examination room, at this time, a mobile stretcher made of a non-metallic material such as a carbon fiber may be used as the mobile stretcher for the sick or wounded, and a method for manually lifting the mobile stretcher arranged at the mobile cart outside the examination room is adopted to move the sick or wounded onto a nuclear magnetic resonance examination table, then the mobile stretcher is removed, and an examination is performed on the sick or wounded. After the examination is completed, the sick or wounded is placed on the mobile stretcher and moved manually onto the mobile cart for fixing the mobile stretcher and the mobile cart again and then performing the movement. Accordingly, the present invention has strong practicability and is applied to a variety of situations to solve the problem that moving the sick or wounded has not yet been resolved currently. The present invention has the main advantages as follows: the mobile stretcher and the mobile cart separately operate; the mobile cart may vertically perform cantilever lifting on the sick or wounded to inwards translate the sick or wounded to the center of the cart and then stably place the mobile stretcher; the lifting tracks may be un-deployed or deployed, so that the volume of the mobile cart is effectively reduced, and thus the present invention is suitable for moving the sick or wounded in the ward; adopting the developable weight-balancing block not only guarantees the stability of the cantilever lifting, but also effectively reduces the volume and the weight of the mobile cart, and facilitates the movement of the mobile cart; and when the mobile cart moves, the mobile stretcher is stably placed on the mobile cart, in this way, the sick or wounded feels safe and reliable when the mobile cart moves, and does not cause psychological burden on the sick or wounded.

DETAILED DESCRIPTION OF PREFERRED EMBODIMENTS

Figure 1:
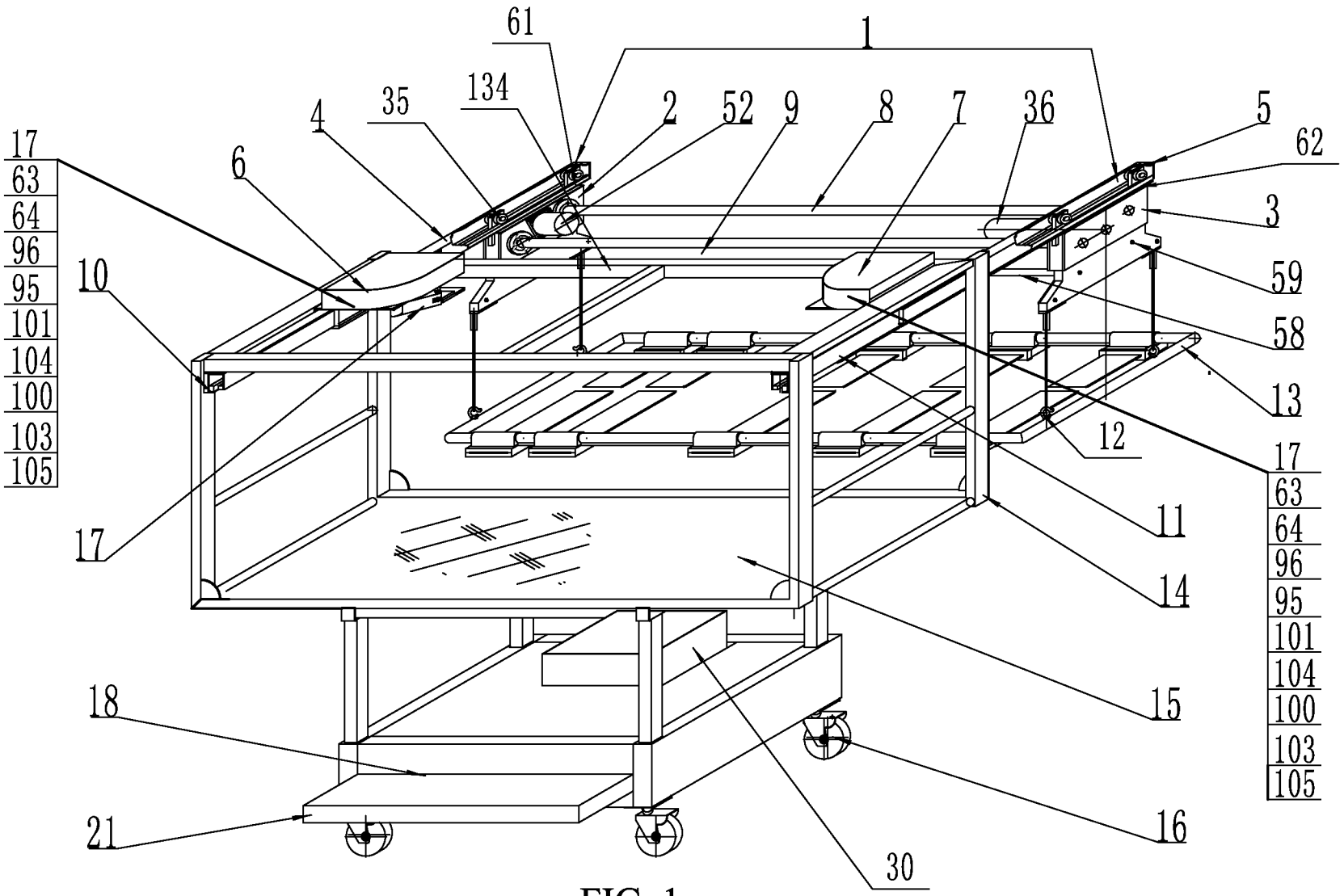
FIG. 1 is a schematic diagram showing an implementation structure of the present invention.
Figure 2:
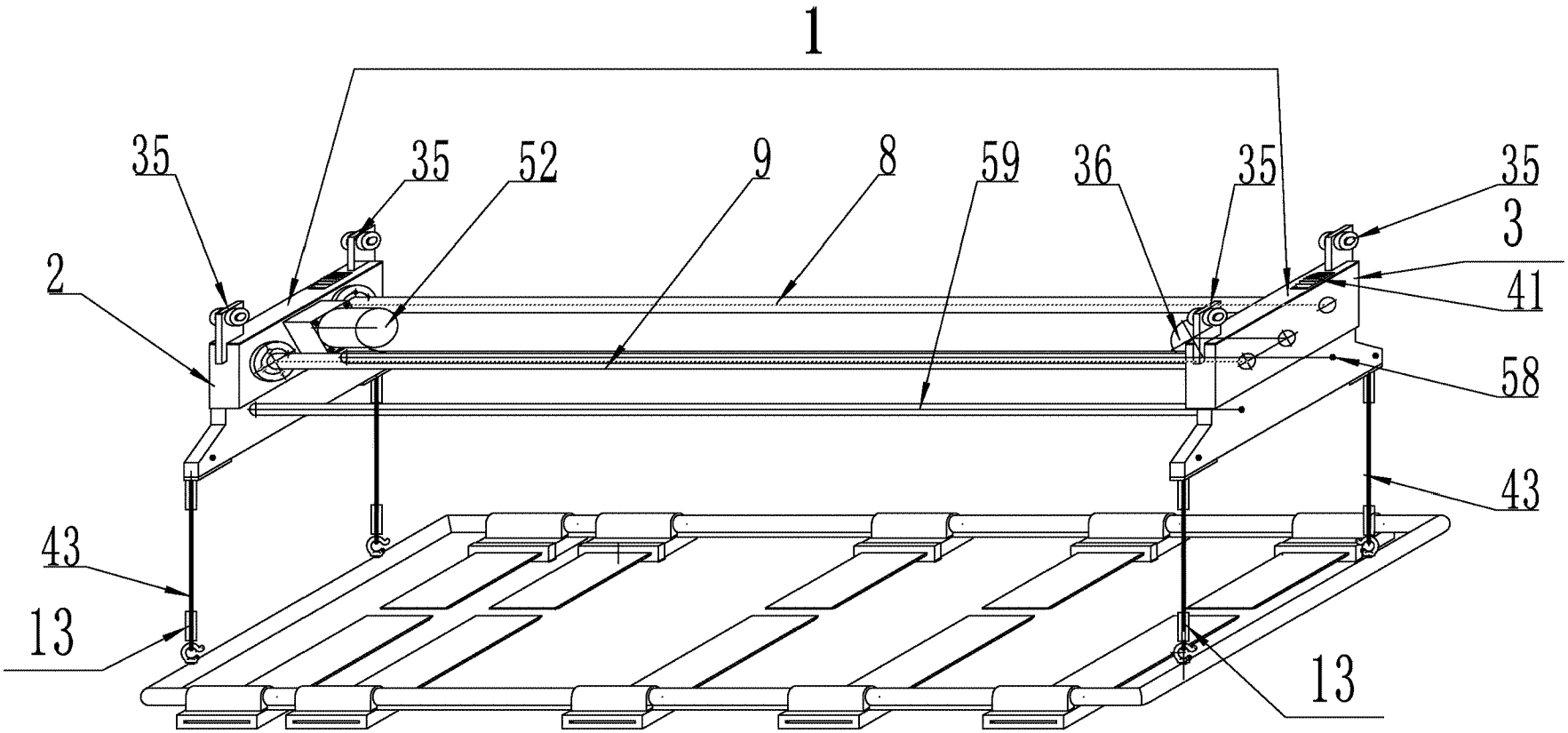
FIG. 2 is a schematic diagram showing a lifting and translating mechanism according to an embodiment of the present invention.
Figure 3:
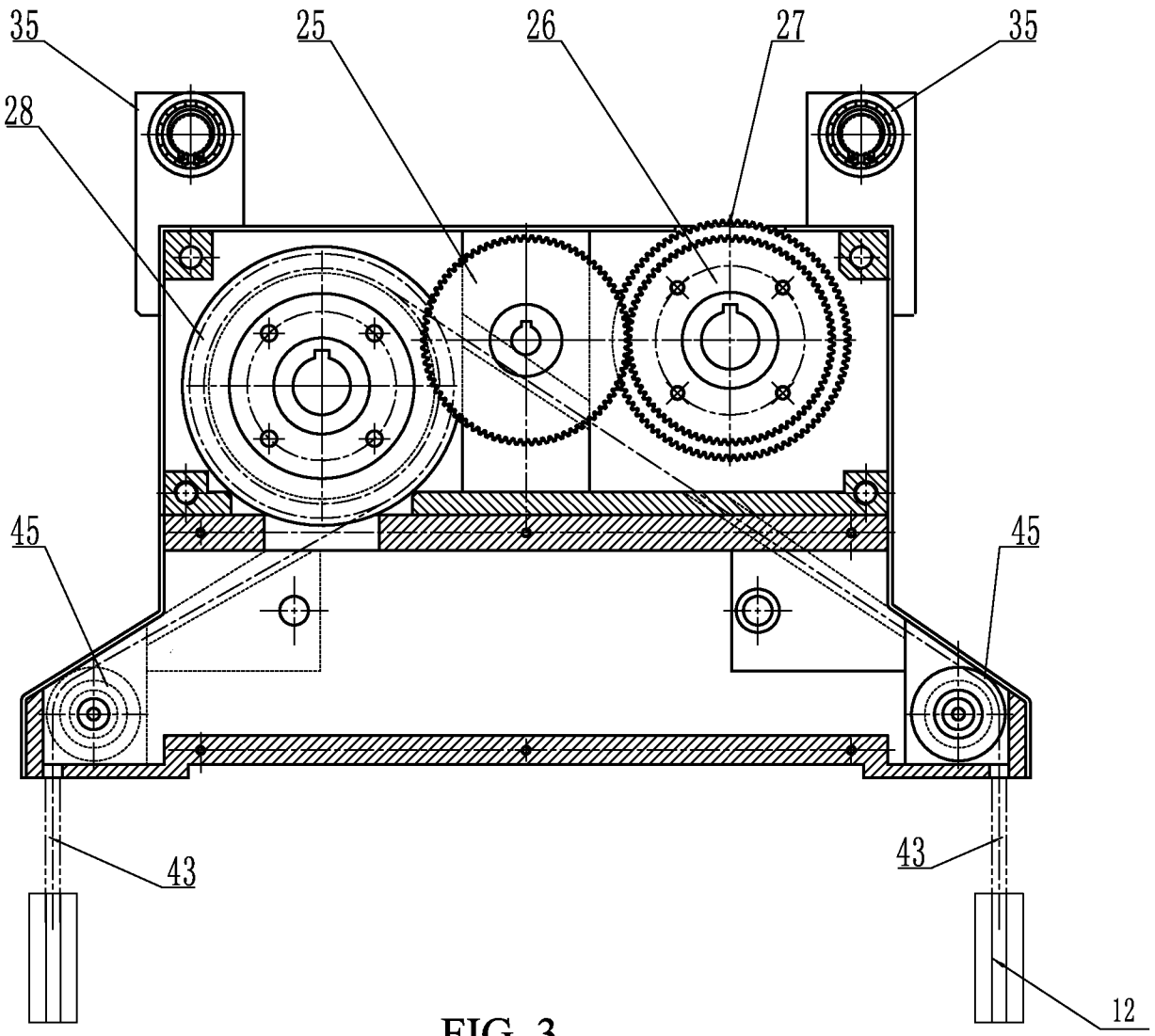
FIG. 3 is a schematic diagram showing a left case of a lifting and translating mechanism according to an embodiment of the present invention.
Figure 4:
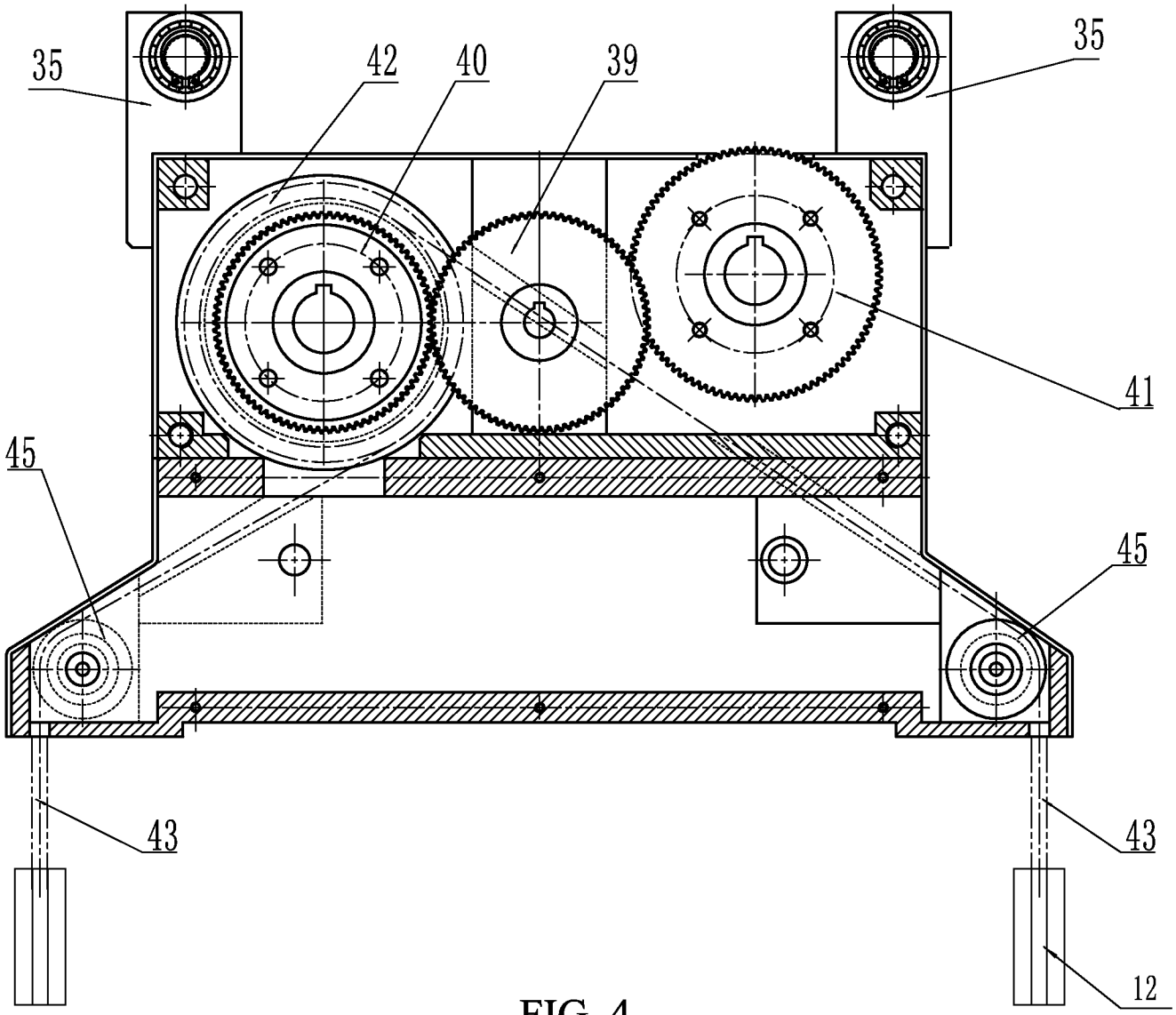
FIG. 4 is a schematic diagram showing a right case of a lifting and translating mechanism according to an embodiment of the present invention.
Figure 5:
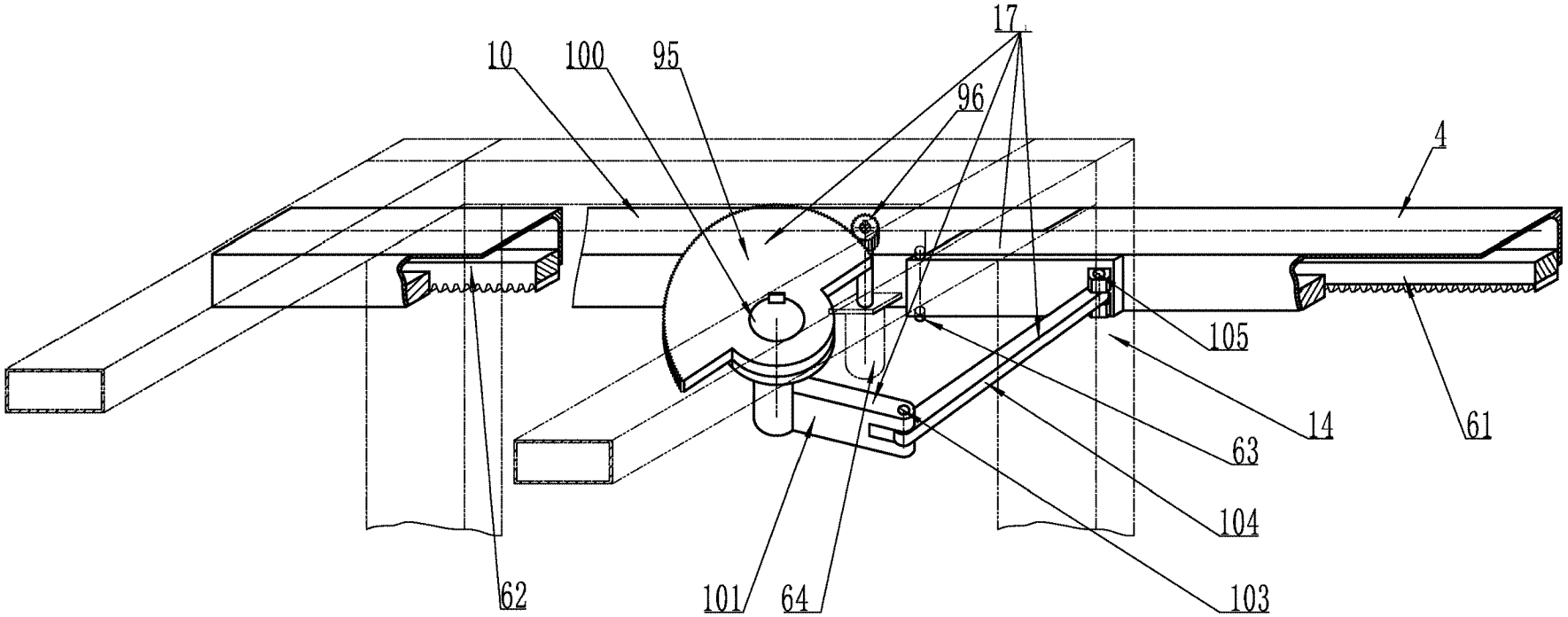
FIG. 5 is a schematic diagram showing a left group of fixed tracks, retractable tracks, and deployment drive mechanisms.
Figure 6:
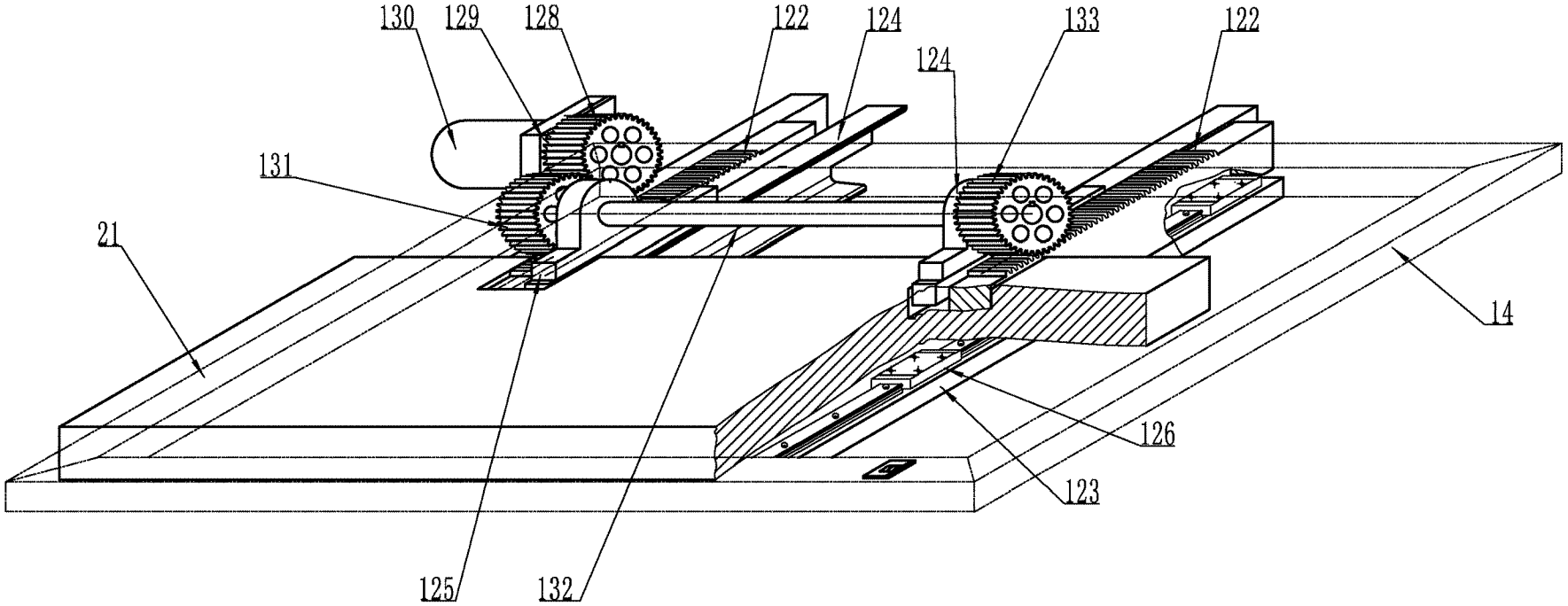
FIG. 6 is a schematic diagram showing an automatic movable weight-balancing mechanism of the present invention.
Figure 7:
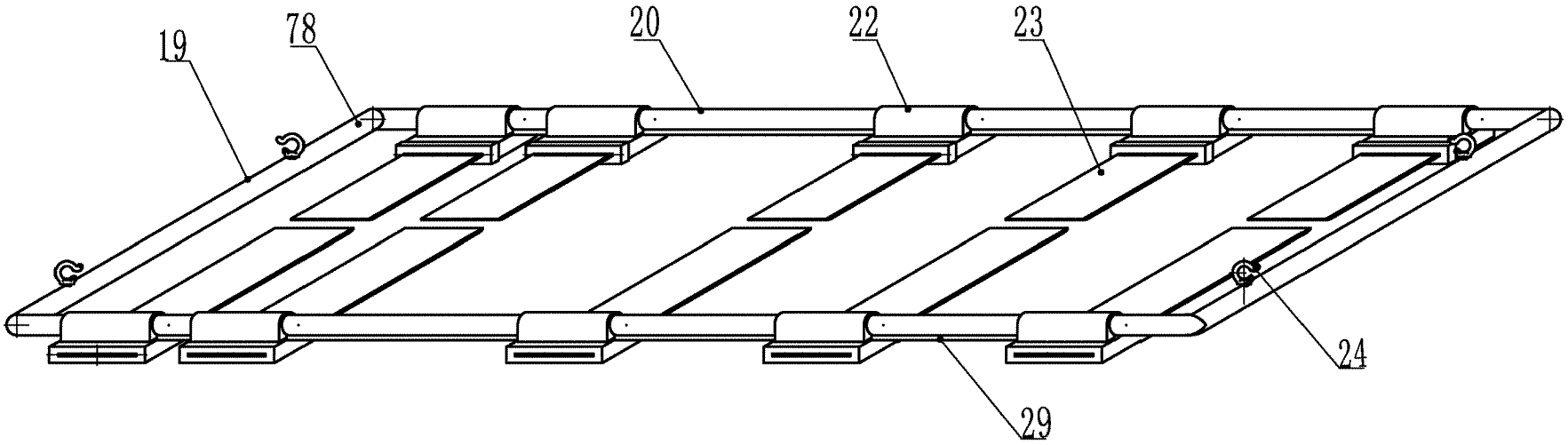
FIG. 7 is a schematic diagram showing a shovel type mobile stretcher for a sick or wounded according to the present invention.
Figure 8:
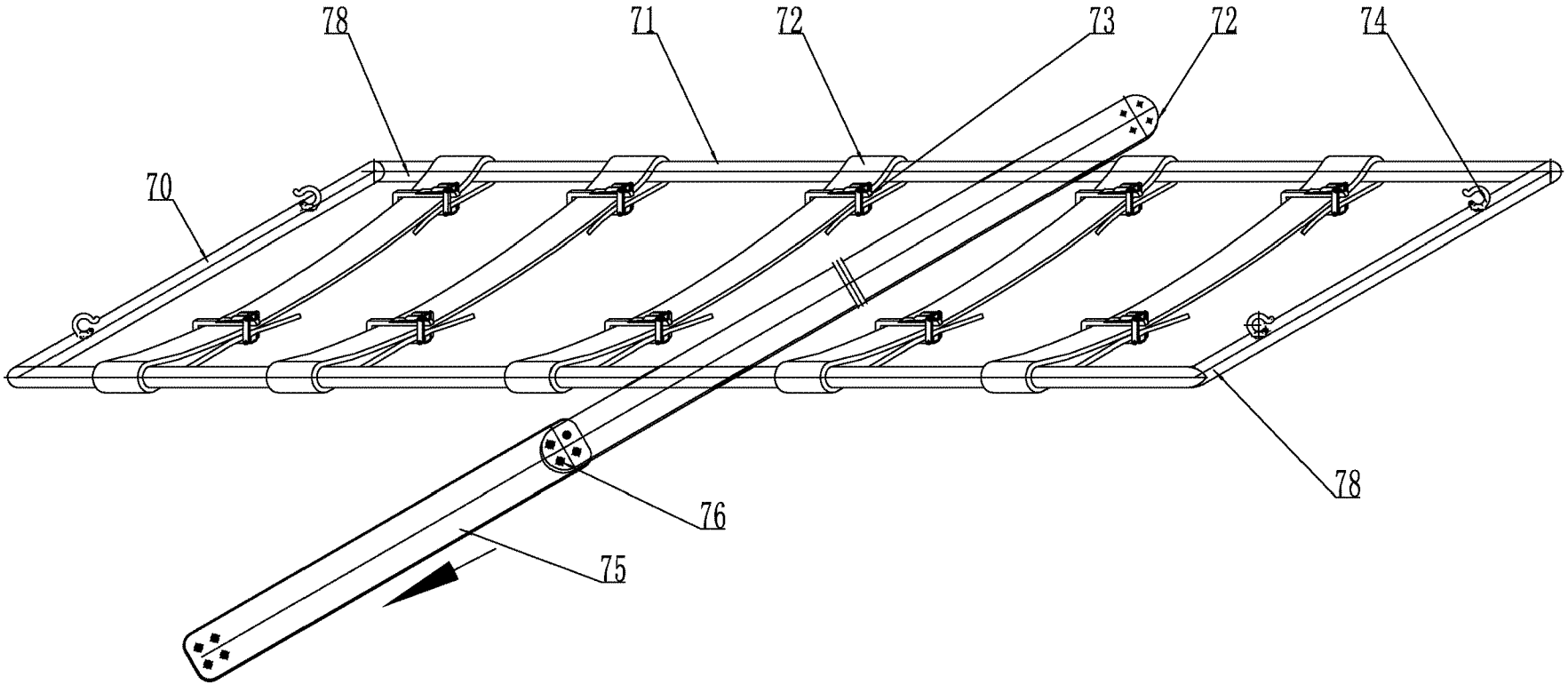
FIG. 8 is a schematic diagram showing a simple mobile stretcher for a sick or wounded of the present invention.
Figure 9:
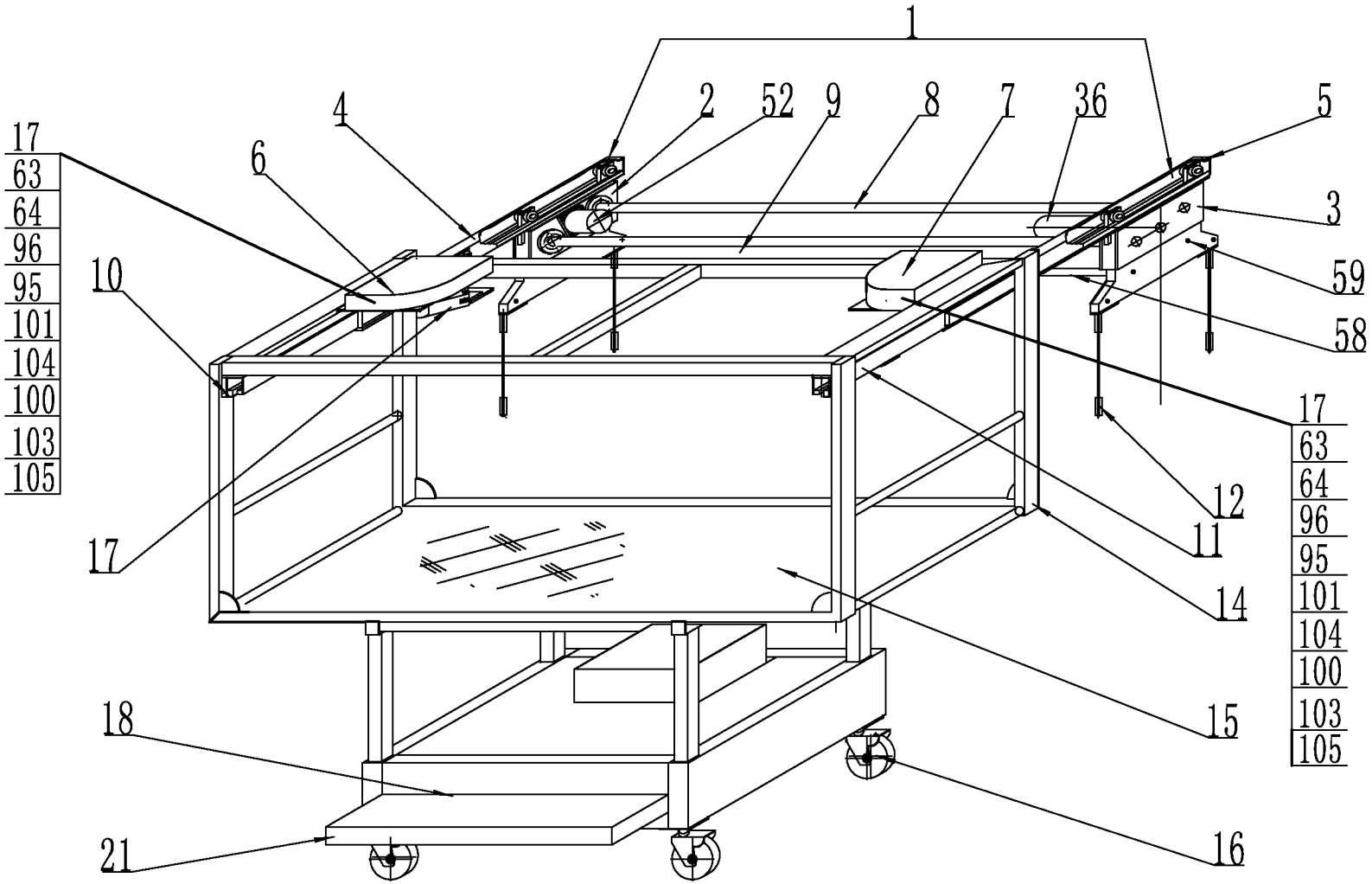
FIG. 9 is a schematic structural view of a mobile cart in an operating condition according to the present invention.
Figure 10:
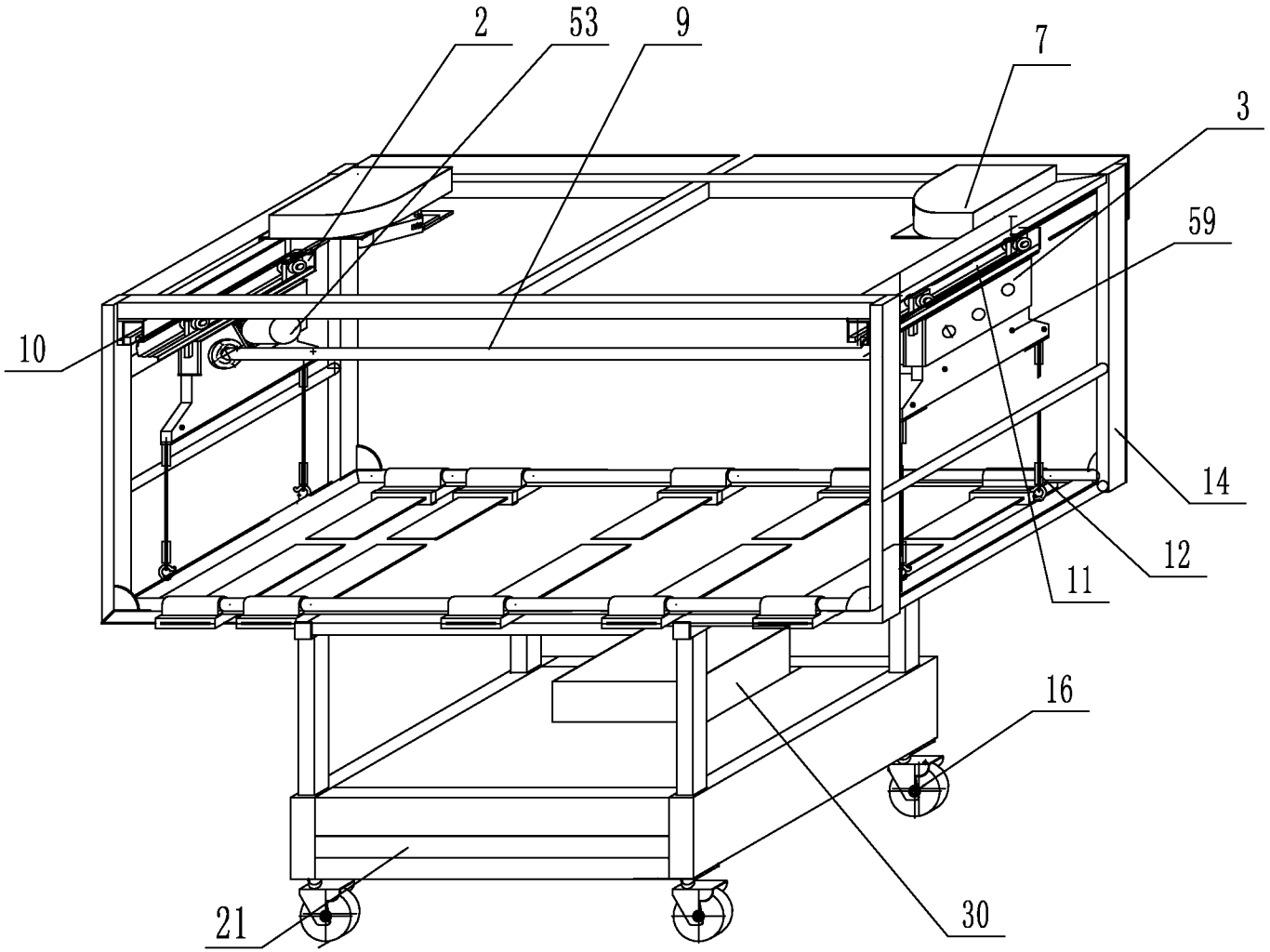
FIG. 10 is a schematic structural view of a mobile cart in a moving condition according to the present invention.

In order to achieve the above objective, a technical solution of the present invention is as follows: a combined mobile cart for a sick or wounded operates according to the following steps. In step 1, a plurality of movable pallets 23 of a shovel type mobile stretcher for a sick or wounded (FIG. 7) are pulled out towards a rectangular frame, then placed at the periphery side of the sick or wounded in a sickbed, and then pushed into the downside of the sick or wounded's body one by one under the manual operation of the nursing staff, so that a plurality of pairs of movable pallets 23 are fully supported under the sick or wounded's body, so as to support the sick or wounded. Alternatively, a simple mobile stretcher for a sick or wounded (as shown in FIG. 8) is adopted, a rectangular frame 78 of the single mobile stretcher for the sick or wounded (as shown in FIG. 8) is placed at the periphery side of the sick or wounded in the sickbed, then an introduction plate 75 and flexible belts 72 are detachably connected by movable couplings 76, the introduction plate 75 is pushed from the downside of the sick or wounded' body and pulled out from the other side under the manual operation of the nursing staff, and then the couplings of the introduction plate 75 and the flexible belts 72 are separated, such that the flexible belts 72 and the introduction plate 75 are separated, and then the flexible belts 72 bypass two cross rods 71 of the rectangular cabinet frame and fixed by using rapid couplings 73 (as shown in FIG. 8), so as to support the sick or wounded's body, and the plurality of flexible belts 72 are successively selected to be in appropriate positions, supported at the lower lying side of the sick or wounded's body, and fixed on the two cross rods 71 of the rectangular frame, so as to support the sick or wounded; In step 2, the mobile cart (as shown in FIG. 10) is moved to a side position of the sick or wounded's body, and then retractable tracks 4, 5 which are arranged at the left side and the right side of the upper part of a main body frame 14 of the mobile cart are opened to respectively enable a lifting and translating mechanism 1 and an automatic movable weight-balancing mechanism 18 to outwards move along the center axial line of the mobile cart, such that the lifting and translating mechanism 1 directly faces the upside of the sick or wounded in a lying state, that is, the upside of the mobile stretcher, and then lifting ropes 43 run downwards to connect suspension tools 12 fixed below the lifting ropes with lifting hooks 24 on the shovel type mobile stretch or lifting hooks 74 on the simple mobile stretcher. At this time, a PLC system controls the lifting ropes to run upwards, and then the mobile stretcher supports the sick or wounded to be lifted together. When the mobile stretcher and the sick or wounded raise to a level which is higher than the height of a stretcher supporting layer, the mobile stretcher and the sick or wounded are immediately translated towards the axial line of the mobile cart and stably run downwards when being translated to an inner dead point, so that the stretcher and the sick or wounded may be stably placed on the supporting layer 15 of the mobile cart. At the same time, the retractable tracks 4, 5 are un-deployed onto lateral rods 134 of the main body frame of the mobile cart. The drive weight-balancing blocks 21 on the automatic movable weight-balancing mechanism 18 are translated towards the interior of the chassis, the combined mobile cart is in a state as shown in FIG. 10. At this time, it is possible to safely, reliably, and stably move the sick or wounded. In step 3, when the combined mobile cart for the sick or wounded is moved to a second desired position, the PLC system controls a left retractable track mechanism 6 and a right retractable track mechanism 7 to operate, the retractable tracks 4, 5 deploy, and the automatic movable weight-balancing mechanism 18 operates to drive the weight-balancing block 21 to translate outwards, the lifting and translating mechanism 1 lifts the mobile stretcher and the sick or wounded, and then translates them outwards to an outer dead point, and then the lifting and translating mechanism drives the lifting ropes to operate to move the mobile stretcher and the sick or wounded downwards, after the mobile stretcher and the sick or wounded arrive at a locating point or an examination bed is placed, the suspension tools 12 are separated from the lifting hooks 24 of the shovel type mobile stretcher or the lifting hooks 74 of the simple mobile stretcher, and the plurality of movable pallets of the shovel type mobile stretcher are pulled out; the shovel type mobile stretcher is removed, a further medical operation may be performed on the sick or wounded. Alternatively, the quick couplings 73 fixed on the flexible belts 72 on the simple mobile stretcher are removed, the flexible belts 72 may be pulled out from the downside of the sick or wounded's body, and then a frame of the simple mobile stretcher is removed, so that the next medical operation may be performed on the sick or wounded. For special medical working conditions, no metal parts are allowed to enter an examination room when a nuclear magnetic resonance examination is performed. In this case, a shovel type mobile stretcher or a simple mobile stretcher made of a carbon fiber or non-metal composite material is adopted, a method for manually lifting the mobile cart outside the examination room is used to move the sick or wounded onto a nuclear magnetic resonance examination table; and for a field or accident scene, due to limited conditions, it is also possible to directly use the shovel type mobile stretcher or the simple mobile stretcher for manual movement, a reasonable supporting point is selected for supporting and moving the sick or wounded without changing a lying position of the sick or wounded, in this way, secondary injury caused by moving the sick or wounded will not be caused.

I claim:

1. A combined mobile cart for a sick or wounded, comprising a mobile cart and a mobile stretcher, wherein the mobile cart comprises a main body frame (14), a left retractable track mechanism (6), a right retractable track mechanism (7), a lifting and translating mechanism (1), and an automatic movable weight-balancing mechanism (18); the left retractable track mechanism (6) and the right retractable track mechanism (7) are arranged on a top of the main body frame (14), and a supporting layer (15) is arranged in a middle of the main body frame (14), the automatic movable weight-balancing mechanism (18) is arranged at a bottom of the main body frame (14), and universal casters (16), a self-contained power supply and a PLC system (30) are arranged under the bottom of the main body frame (14); the left retractable track mechanism (6) and the right retractable track mechanism (7) are respectively arranged at a left side and a right side on the top of the main body frame (14), and the lifting and translating mechanism is formed by fixedly assembling a left case body (2) and a right case body (3) via a first linkage rod (8) and a second linkage rod (9) as well as a first interval-controlling rod (58) and a second interval-controlling rod (59), and supported by left and right case-frame travelling wheels (35) to run on tracks of a first fixed track (10), a second fixed track (11), a first retractable track (4) and a second retractable track (5) on the top of the main body frame (14), so as to reciprocate along an axial line when the retractable tracks deploy; lifting ropes (43) are arranged below the left case body (2) and the right case body (3) of the lifting and translating mechanism, and suspension tools (12) are connected with the lifting ropes (43) for vertically lifting and vertically moving the mobile stretcher; the automatic movable weight-balancing mechanism (18) is arranged at the bottom of the main body frame (14), and the automatic movable weight-balancing mechanism (18) is configured to move outwards under driving of a drive weight-balancing block (21) so as to balance a force moment in lifting when the lifting and translating mechanism (1) is moved outwards to a lifting position, and configured to move towards the inside of the main body frame under the driving of the drive weight-balancing block (21) when the lifting and translating mechanism (1) completes vertical lifting and inward movement, so as to reduce a space to facilitate the movement of the mobile cart; the self-contained power supply for supplying power to drive the mobile cart and the PLC system (30) for operation controlling are arranged at the bottom of the main body frame (14); the mobile stretcher (13) adopts a shovel type mobile stretcher for the sick or wounded, a simple mobile stretcher for the sick or wounded, or an easy-to-move mobile stretcher; and the mobile stretcher (13) is arranged below the left case body (2) and the right case body (3) of the lifting and translating mechanism of the mobile cart, and the suspension tools (12) arranged below the left case body (2) and the right case body (3) of the lifting and translating mechanism (1) is configured to lift the mobile stretcher (13).

2. The combined mobile cart according to claim 1, wherein the lifting and translating mechanism (1) is formed by assembling the left case body (2) and the right case body (3) via the first linkage rod (8) and the second linkage rod (9) as well as the first interval-controlling rod (58) and the second interval-controlling rod (59); the case-frame travelling wheels (35) are arranged above the left case body (2) and the right case body (3), a left case lifting passive rope sheave (28) is arranged at a left side in a middle of the left case body (2), a right case lifting active rope sheave (42) is arranged at a left side in a middle of the right case body (3), the lifting ropes (43) are encircled around of the active and passive rope sheaves, and the lifting ropes (43) are connected with the suspension tools (12) via rope guiding wheels (45) arranged at two sides at the bottom of each of the left case body and the right case body; a drive motor (36) is arranged in the middle inside the right case body, the drive motor (36) is coaxially connected with a right case rope sheave drive active gear (39), the right case rope sheave drive active gear (39) is meshed with a rope sheave drive passive gear (40), the rope sheave drive passive gear (40) and the lifting active rope sheave (42) are coaxially linked with the left case lifting driven rope sheave (28) though the second linkage rod (9), such that the lifting ropes (43) drive the suspension tools (12) to vertically move up and down; a left case translating active gear (27) and a right case translating active gear (41) for driving the lifting and translating mechanism (1) to translate on the tracks are respectively arranged above middles of the left case body (2) and the right case body (3), a translating drive motor (52) and a left case translating transmission active gear (25) are arranged at an inner side and in the middle of the middle of the left case and are coaxially linked for transmission, the left case translating transmission active gear (25) is meshed with a left case duplicate gear (26), a duplicate gear is combined by the left case translating active gear (27) and the left case duplicate gear (26), the left case duplicate gear (26) is coaxially linked via the first linkage rod (8), with the right case translating active gear (41) arranged at the upper-right side of the right case, and respectively meshed with racks (62) arranged at lower levels of the retractable tracks above the left case and the right case; when the translating drive motor (52) operates, the left case translating transmission active gear (25) is meshed with the left case duplicate gear (26) to drive the left case translating active gear (27) and the right case translating active gear (41) to be meshed with the racks (62) for operation under the action of the linkage rod (8), so that the lifting and translating mechanism axially translates on the retractable tracks.

3. The combined mobile cart according to claim 1, wherein retractable track mechanisms are formed by assembling the first fixed track (10), the second fixed track (11), the first retractable track (4) and the second retractable track (5); deployment drive motors (64) are configured to drive four-bar linkage mechanisms (17), and hence drive the first retractable track (4) and the second retractable track (5); the first fixed track (10) and the second fixed track (11) are symmetrically arranged at the left side and the right side on the top of the main body frame, and a first rack (61) and a second rack (62) are arranged at the bottoms of the fixed tracks and the retractable tracks, respectively, and meshed with the left case translating active gear (27) and the right case translating active gear (41) of the lifting and translating mechanism, respectively; the retractable tracks are arranged oppositely in two groups, i.e., a left group and a right group; the first retractable track (4) and the second retractable track (5) are retractably connected with left and right first fixed tracks (10) and left and right second fixed tracks (11) by hinges (63), tightly clung to a lateral rod (134) of the main body frame during un-deploying, and are in a cantilever state during deploying, at this moment, the lifting and translating mechanism is moved outwards to be in a vertically-lifting operation state; first racks (61) and second racks (62) are arranged at bottoms of two groups of first fixed tracks (10) and second fixed tracks (11) as well as first retractable tracks (4) and second retractable tracks (5); when the first retractable tracks (4) and the second retractable tracks (5) are un-deployed, the lifting and translating mechanism (1) is moved outwards, and the left case translating active gear (27) and the right case translating active gear (41) are respectively meshed with the first racks (61) and the second racks (62); the four-bar linkage mechanisms (17) comprise a left group and a right group with each group comprising the deployment drive motor (64), a coaxial gear (96) of the deployment drive motors (64), a transmission large gear (95), a transmission crank (101), a transmission link (104) and the retractable track (5), and the two groups are correspondingly arranged; the coaxial gear (96) connected with the drive motor is meshed with the transmission large gear (95), a center hole of the transmission large gear (95) is in key joint with the supporting layer (15) of the mobile cart, and a transmission shaft (100) and the transmission crank (101) are integrally connected, the transmission crank (101) and the transmission link (104) are slidably connected via a first hinge pin (103), and the transmission link (104) and the first retractable track (4) and the second retractable track (5) are slidably connected by a second hinge pin (105), and the deployment drive motor (64) moves forward and backward through a meshing operation of the coaxial gears (96) with the transmission large gear (95) so as to drive the transmission crank (101) to move, so that the transmission link (104), the first retractable track (4) and the second retractable track (5) un-deploy or deploy.

4. The combined mobile cart according to claim 1, wherein the automatic movable weight-balancing mechanism (18) is arranged at the bottom of the main body frame (14), and is formed by assembling a driving weight-balancing block (21), racks (122), a track (123) and a driving member; the driving weight-balancing block (21) is fixedly disposed within the main body frame (14), and fixed with the racks (122) arranged at an inner side of the driving weight-balancing block; the track (123) is fixed below the driving weight-balancing block (21) and the racks (122), the driving weight-balancing block (21) is connected with a track guide block (126), and the track guide block (126) and the track (123) slide for operation; the driving member is coaxially linked by the driving motor (130) to drive the active gear (128) to operate; the driving motor (130) is fixed on a supporting plate (129) at the bottom of the main body frame to drive the active gear (128) to be meshed with a first rack driving gear (131) and a second rack driving gear (133); two rack driving gears are comprised, namely, a first rack driving gear (131) and a second rack driving gear (133), which are linked by a linkage rod (132), and the linkage rod (132) is fixed on the driving weight-balancing block by a first bearing seat (124) and a second bearing seat (125); the driving motor (130) operates to drive the active gear (128) to rotate, so as to drive the first rack driving gear (131) to rotate, and drive the second rack driving gear (133) to rotate under the action of the linkage rod (132), thereby driving the racks (122) connected with the weight-balancing block (21) to operate, and then driving the weight-balancing block (21) to inwards translate along the axial line of the track (123) at the bottom of the main body frame (14).

5. The combined mobile cart according to claim 1, wherein the mobile stretcher is of a shovel type mobile stretcher for the sick or wounded or a simple mobile stretcher for a sick or wounded, the shovel type mobile stretcher is a rectangular cabinet rack including cross rods (20) and longitudinal rods (19) of the stretcher; a plurality of groups of corresponding movable pallet supporting bases (22) are arranged on the cross rods (20) of the stretcher, and through holes are disposed above the movable pallet supporting bases and pass through the cross rods (20) of the stretcher; a constraint key (29) is disposed below the cross rods to constrain that the movable pallet supporting bases make a circumference rotation about axial lines of the cross rods; a key slot is disposed inside the through holes above movable pallets so as to be matched with the constraint key (29); the movable pallets are disposed in rectangular holes below movable pallet bases; and a plurality of lifting hooks (24) are arranged at the longitudinal rods (19); the simple mobile stretcher for the sick or wounded is a rectangular cabinet rack composed of longitudinal rods (70) and cross rods (71), a plurality of movable flexible belts (72) are movably connected with an introduction plate (75) at the bottom of a sick or wounded's body by couplings (76), separated from an introduction sheet after passing through the bottom of the sick or wounded's body under the guidance of the introduction sheet, remained at the bottom of the sick or wounded's body, rapidly fastened by rapid couplings (73) via the cross rods, so as to support the sick or wounded; and a plurality of lifting hooks (74) are arranged at the longitudinal rods (70) for matching with the suspension tools (12), which are arranged at the lifting and translating mechanism (1), of the mobile cart to lift and translate the sick or wounded.

6. The combined mobile cart according to claim 1, wherein a method for using the combined mobile cart comprises the following steps:

step 1, a plurality of movable pallets (23) of a shovel type mobile stretcher are pulled out towards a rectangular frame, then placed at the periphery side of the sick or wounded in a sickbed, and then pushed into the downside of the sick or wounded's body one by one under the manual operation of the nursing staff, so that a plurality of pairs of movable pallets (23) are fully supported under the sick or wounded's body, so as to support the sick or wounded; alternatively, a simple mobile stretcher for a sick or wounded is adopted, a rectangular frame (78) of the single mobile stretcher for the sick or wounded is placed at the periphery side of the sick or wounded in the sickbed, then an introduction plate (75) and flexible belts (72) are detachably connected by movable couplings (76), the introduction plate (75) is pushed from the downside of the sick or wounded' body and pulled out from the other side under the manual operation of the nursing staff, and then the couplings of the introduction plate (75) and the flexible belts (72) are separated, such that the flexible belts (72) and the introduction plate (75) are separated, and then the flexible belts (72) bypass two cross rods (71) of the rectangular cabinet frame and fixed by using rapid couplings (73), so as to support the sick or wounded's body, and the plurality of flexible belts (72) are successively selected to be in appropriate positions, supported at the lower lying side of the sick or wounded's body, and fixed on the two cross rods (71) of the rectangular frame, so as to support the sick or wounded;

step 2, the mobile cart is moved to a side position of the sick or wounded's body, and then a first retractable track (4) and a second retractable track (5) which are arranged at the left side and the right side of the upper part of a main body frame (14) of the mobile cart are opened to respectively enable a lifting and translating mechanism (1) and an automatic movable weight-balancing mechanism (18) to outwards move along the center axial line of the mobile cart, such that the lifting and translating mechanism (1) directly faces the upside of the sick or wounded in a lying state, that is, the upside of the mobile stretcher, and then lifting ropes (43) run downwards to connect suspension tools (12) fixed below the lifting ropes with lifting hooks (24) on the shovel type mobile stretch or lifting hooks (74) on the simple mobile stretcher; at this time, a PLC system controls the lifting ropes to run upwards, then the mobile stretcher supports the sick or wounded to be lifted together; when the mobile stretcher and the sick or wounded raise to a level which is higher than the height of a stretcher supporting layer, the mobile stretcher and the sick or wounded are immediately translated towards the axial line of the mobile cart and stably run downwards when being translated to an inner dead point, so that the stretcher and the sick or wounded may be stably placed on the supporting layer (15) of the mobile cart; at the same time, the first retractable track (4) and the second retractable track (5) are un-deployed onto lateral rods (134) of the main body frame of the mobile cart; the drive weight-balancing blocks (21) on the automatic movable weight-balancing mechanism (18) are translated towards the interior of the chassis, at this time, it is possible to safely, reliably, and stably move the sick or wounded;

step 3, when the combined mobile cart for the sick or wounded is moved to a second desired position, the PLC system controls a left retractable track mechanism (6) and a right retractable track mechanism (7) to operate, the first retractable track (4) and the second retractable track (5) deploy, and the automatic movable weight-balancing mechanism (18) operates to drive the weight-balancing block (21) to translate outwards, the lifting and translating mechanism (1) lifts the mobile stretcher and the sick or wounded, and then translates them outwards to an outer dead point, and then the lifting and translating mechanism drives the lifting ropes to operate to move the mobile stretcher and the sick or wounded downwards, after the mobile stretcher and the sick or wounded arrive at a locating point or an examination bed is placed, the suspension tools (12) are separated from the lifting hooks (24) of the shovel type mobile stretcher or the lifting hooks (74) of the simple mobile stretcher, and the plurality of movable pallets of the shovel type mobile stretcher are pulled out;

the shovel type mobile stretcher is removed, a further medical operation may be performed on the sick or wounded; alternatively, the quick couplings (73) fixed on the flexible belts (72) on the simple mobile stretcher are removed, the flexible belts (72) may be pulled out from the downside of the sick or wounded's body, and then a frame of the simple mobile stretcher is removed, so that the next medical operation may be performed on the sick or wounded; for special medical working conditions, no metal parts are allowed to enter an examination room when a nuclear magnetic resonance examination is performed; in this case, a shovel type mobile stretcher or a simple mobile stretcher made of a carbon fiber or non-metal composite material is adopted, a method for manually lifting the mobile cart outside the examination room is used to move the sick or wounded onto a nuclear magnetic resonance examination table; and for a field or accident scene, due to limited conditions, it is also possible to directly use the shovel type mobile stretcher or the simple mobile stretcher for manual movement, a reasonable supporting point is selected for supporting and moving the sick or wounded without changing a lying position of the sick or wounded, in this way, secondary injury caused by moving the sick or wounded will not be caused.

* * * * *